US005901612A

United States Patent [19]

Letovsky

[11] Patent Number: 5,901,612

[45] Date of Patent: May 11, 1999

[54] DUAL AXIS MECHANICALLY ACTUATED MOTION PLATFORM

[76] Inventor: Howard Letovsky, P.O. Box 1925, Willits, Calif. 95490

[21] Appl. No.: 08/990,563

[22] Filed: Dec. 15, 1997

[51] Int. Cl.[6] ..... G05G 7/00; A47C 31/00

[52] U.S. Cl. ..... 74/471 XY; 248/661; 297/217.1; 297/314; 434/29

[58] Field of Search ..... 74/471 XY; 297/314, 297/217.1; 248/651, 661, 663; 434/29

[56] References Cited

U.S. PATENT DOCUMENTS

| | | | |
|---|---|---|---|
| 560,228 | 5/1896 | Nelson | 297/314 |
| 3,384,374 | 5/1968 | Boothe | 74/471 XY |
| 4,584,896 | 4/1986 | Letovsky | 74/479 |
| 4,607,919 | 8/1986 | Gartner et al. | 74/471 XY |
| 5,195,746 | 3/1993 | Boyd | 273/148 B |
| 5,409,295 | 4/1995 | Edstrom | 297/314 |
| 5,431,569 | 7/1995 | Simpkins | 434/29 |

*Primary Examiner*—Allan D. Herrmann

[57] ABSTRACT

A dual axis mechanically actuated motion platform which allows a user to move him or herself through a wide range of angular displacement in two intersecting axes individually or simultaneously by apply manual pressure to a lever in the direction of desired angular displacement. The motion platform is comprised of a base frame, a user support platform mounted on top of a universal joint, and a bearing mounted, preloaded offset linkage system coupled to a joystick lever. The offset linkage system creates enough increased mechanical advantage to move the seat platform in concert with the movement of the joystick lever, providing the user with the feeling of controlling an aircraft and the attendant sensations of pitch and roll motion.

3 Claims, 3 Drawing Sheets

DUAL AXIS MECHANICALLY ACTUATED MOTION PLATFORM

BACKGROUND—FIELD OF INVENTION

This invention relates generally to mechanisms which are normally used to provide occupant motion in simulated aircraft. More specifically, the present invention relates to such simulated vehicles used for training or amusement purposes in conjunction with visual displays.

BACKGROUND—DESCRIPTION OF PRIOR ART

Simulated vehicle motion platforms have been used for decades to train all manner of vehicle operators in safe, repeatable, and observable conditions. Motion platforms are being used more extensively than ever before in the amusement industry to add realism to film, video, and computer generated visual entertainment experiences. Most simulated vehicles are complex devices which utilize motors, air compressors, or hydraulic systems to provide motion in one or more axes. Systems which use the aforementioned elements require specialized electronic circuitry and computer programming to effectively adapt the response of the motion platform to different visual media. These systems are generally expensive to produce and require a high level of technical expertise to maintain.

My own U.S. Pat. No. 4,584,896 describes an electromechanical multi-axis motion platform, which, although effective for its proposed purpose, does not meet the criteria of combining simplicity with a broad application base intended to be satisfied by the current invention disclosed herein. U.S. Pat. No. 5,431,569 discloses a manually powered computer interactive motion simulator which requires the use of various sized weights to counter balance the loads of different sized operators suspended from a support arm. This mechanism is more suited to use in low traffic situations rather than broad public arenas because of the weight adaptations needed for each individual user. U.S. Pat. No. 5,195,746 discloses a video display control apparatus which is basically a seat mounted on top of a typical arcade joystick. The operator pushes against base mounted handles to effect motion. In this arrangement, the operator is creating motion contrary to the position of the control arms, which is the opposite of a true aircraft control system. Aircraft controls always move the craft in the direction that they are moved.

As the volume and quality of film and computer generated visual product has increased, it has become necessary to create an aircraft simulating dual axis motion platform which can be easily interfaced to any visual display system, provide realistic physical response effects to the user, be safe and durable in wide public use, be operable intuitively, and be cost effective.

OBJECTS AND ADVANTAGES OF THE PRESENT INVENTION

The object of the present invention is to provide a realistic simulation of the exemplary pitch and roll sensations experienced while controlling an aircraft with a floor mounted joystick.

Another object of the invention is to provide a motion platform which can be operated manually by a wide range of users with very little effort. In the preferred embodiment of the present invention, a seat is mounted to an operator support platform which is carried by a roller bearing universal joint mounted on top of a support tower. This arrangement insures that the overall coefficient of friction of movement of the operator support platform is extremely small. A joystick lever assembly is carried between two towers mounted on top of the base frame and coupled to the operator support platform through a linkage system. Because the user operates the joystick lever at a distance of several feet from the pivot point of the lever and the linkages are placed at a distance offset from the pivot points of the universal joint, a large mechanical advantage is created from the lever motion. A coil spring is employed to offset to the load shifts of the operator. Moving the joystick lever in any direction causes the operator support platform to move in the same direction, accurately simulating the pitch and roll motion of an aircraft. The unique linkage and spring arrangement of the invention allows operators weighing from forty to four hundred pounds to experience virtually the same range of motion with the same amount of effort.

Another object of the invention is to provide automatic centering of the operator support platform when not in use. Since so little force is required to move the operator support platform, the coil spring mounted between the operator support platform and the base frame urges the operator support platform back to the center position when the machine is empty.

Another object of the invention is to allow synchronized interaction between the movements of the motion platform and visual displays. Standard position sensors can be easily mounted directly to the moving elements of the linkage system to provide pitch and roll information outputs. These outputs can be wired to interact with any visual display system.

The advantages of the present invention over the prior art include realistic simulation of aircraft motion through a direct drive mechanism, ease of use by a broad range of operators, universal interfaceability with different visual display systems, low production and assembly costs, and minimal maintenance.

The above described advantages and many other features and attended advantages of the present invention will become better understood by reference to the following detailed description when taken in conjunction with the drawing FIGS. 1 through 6.

DESCRIPTION OF THE INVENTION

The invention disclosed herein is a unique dual axis mechanically actuated motion platform which allows an operator to move him or herself through a wide range of angular displacement in two intersecting axes individually or simultaneously by applying manual pressure to a joystick lever 64 in the direction of desired angular displacement. A larger operator sitting in the seat 93 will experience essentially the same motion and usability of the invention as a smaller operator. The center of gravity of an operator, concentrated directly above the universal joint 98, offsets the shifting load of the operator's extremities in conjunction with the unique placement of resistance inducing coil spring 110, which effectively neutralizes the overhung load.

Figure 1:
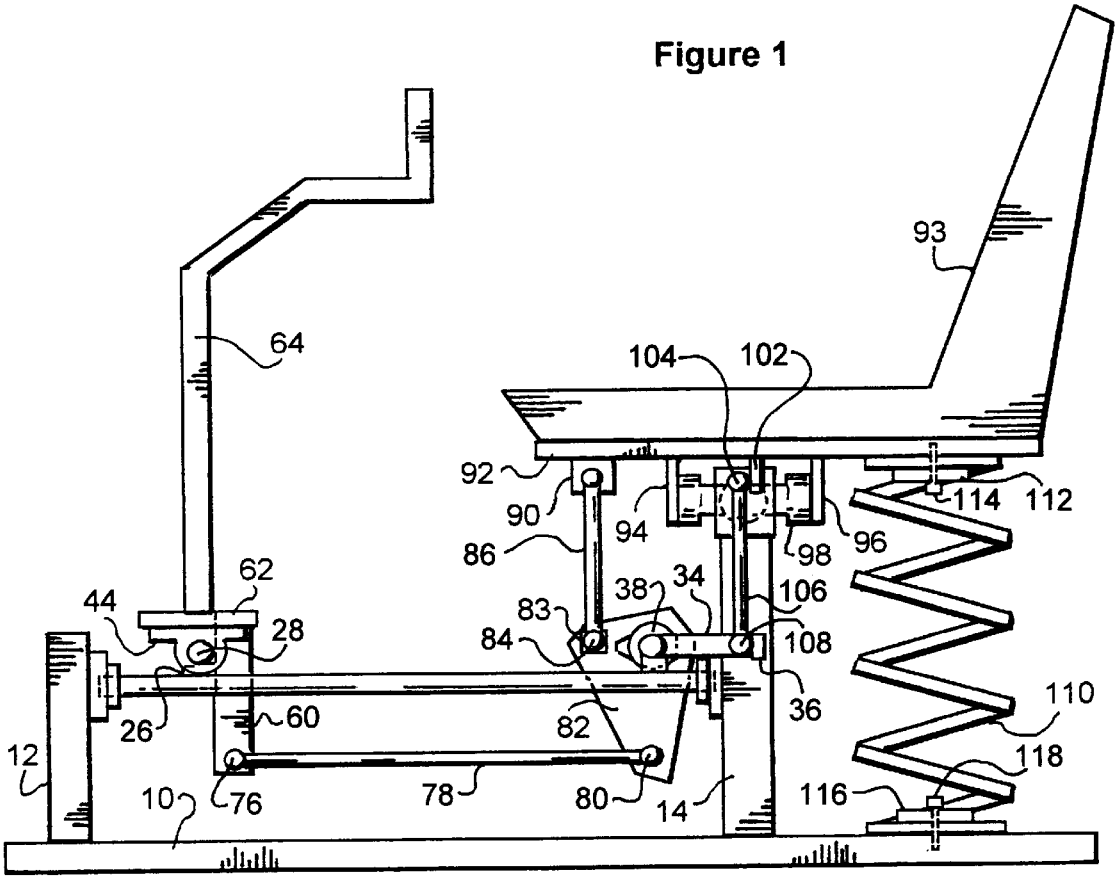
FIG. 1 is a side elevation view showing a preferred exemplary dual axis mechanically actuated motion platform in accordance with the present invention.
Figure 2:
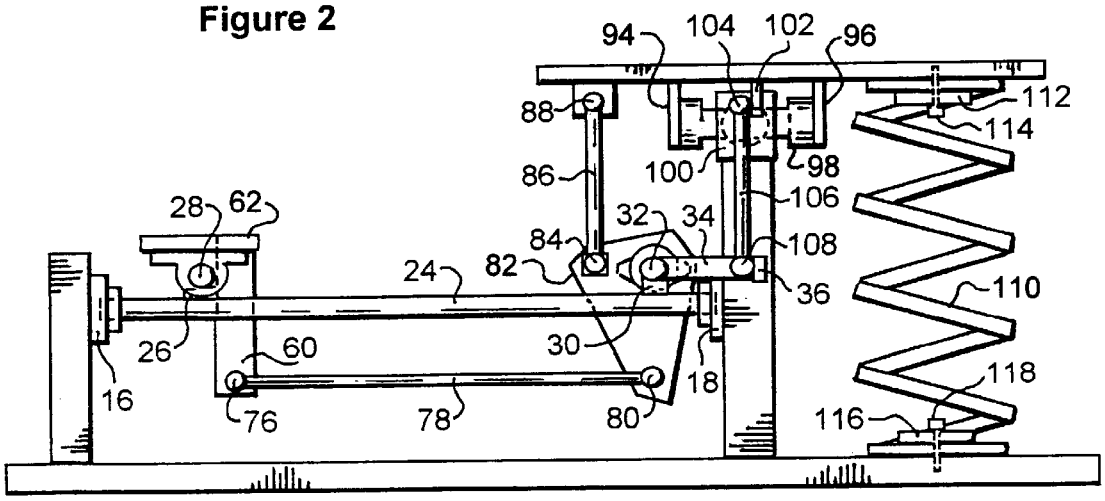
FIG. 2 is also a side elevation view of the motion platform, except that the joystick lever and seat are not shown and additional numbering of parts has been added for clarity.
Figure 3:
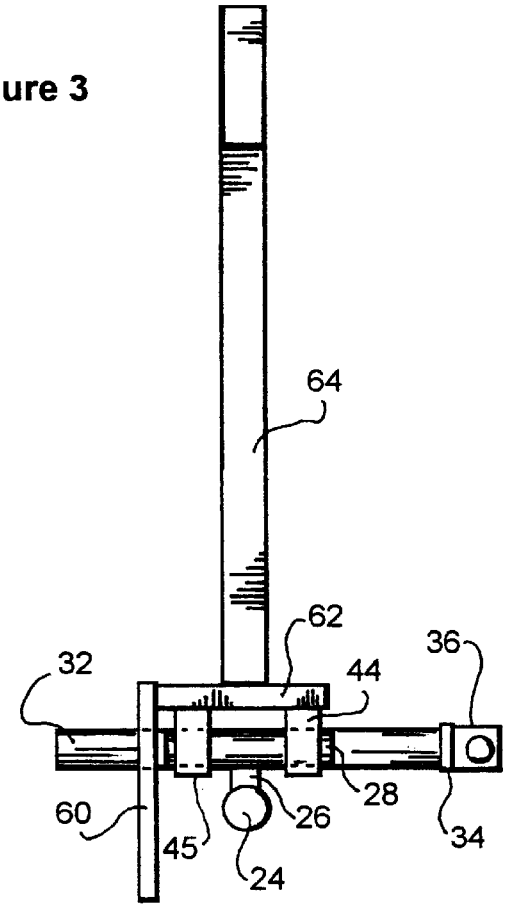
FIG. 3 is a front-on view of the joystick lever and central shaft assembly.
Figure 4:
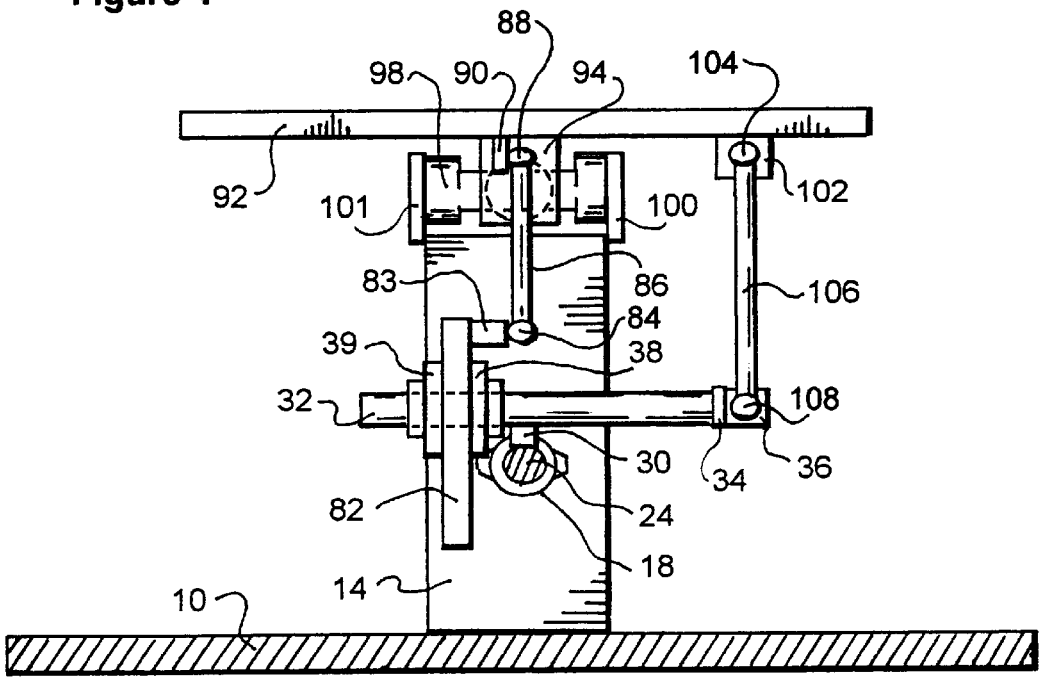
FIG. 4 is a front-on view detailing the bellcrank, upper linkages, and main shaft assembly as if the motion platform had been cut in halfjust forward of the bellcrank. The coil spring has been removed for clarity in this view.

The preferred embodiment of the dual axis mechanically actuated motion platform in accordance with the present invention as detailed in FIG. 1 and partially detailed in FIGS. 2, 3, and 4, includes a four feet long by three feet wide base frame 10 which rests on any suitable structural support or floor surface. The base frame 10 can be made of steel, hardwood, plastic, composite, or any other suitably rigid material. A five inch wide by eighteen inch high by two inch thick universal joint support tower 14 is centrally attached to the top surface of base frame 10, eighteen inches forward of the rear edge of base frame 10.

One axis of a standard Spicer model 1610 universal joint assembly 98 is fixedly attached to a pair of two inch square mounting plates 100 and 101, which are fixedly attached to the left and right upper edges of the universal joint support tower 14.

The second axis of the universal joint 98 is fixedly attached to a pair of two inch square mounting plates 94 and 96, which are fixedly attached to the underside of a sixteen inch square seat mounting plate 92. This configuration provides the seat mounting plate 92 a range of motion of plus or minus forty-five degrees in two intersecting axes.

The bottom surface of a five inch wide by ten inch high by two inch wide bearing support tower 12 is fixedly attached centrally to the top surface of base frame 10, six inches behind the forward edge of base frame 10. A standard flange type pillow block bearing 16 is bolted one inch below the top edge of the rear face of bearing support tower 12.

The forward end of a twenty four inch long by one inch diameter main shaft 24 is fitted into pillow block 16. The rearward end of main shaft 24 is set into a second pillow block 18, which is bolted to the front face of universal joint support tower 14. The main shaft is positioned in a horizontal plane above and parallel to the length of base frame 10, eight inches below the universal joint 98.

A six inch long by one inch diameter shaft 28 is welded or otherwise fixedly attached through mounting plate 26 to the top surface of the main shaft 24, five inches behind the front edge of the main shaft 24. Shaft 28 is mounted perpendicular to the length of the main shaft 24. A pair of base mount type standard pillow blocks 44 and 45 are fitted onto either end of shaft 24 and fixedly attached to joystick lever base plate 62. A two foot tall joystick lever 64 is fixedly attached to the upper surface of lever base plate 62.

Welded or otherwise fixedly attached to the right side and towards the rearward edge of lever base plate 62, and extending downward, is a two inch wide by five inch long linkage rod mounting bracket 60. A rod end 76 connects linkage rod mounting bracket 60 to linkage rod 78, which extends rearward. The other end of linkage rod 78 is connected to bellcrank 82 through rod end 80.

Bellcrank 82 is fitted with a pair of pillow blocks 38 and 39 which are mounted in line with each other on either side of a one and a quarter inch diameter hole bored through the upper rear quadrant of bellcrank 82.

A ten inch long by one inch diameter shaft 32 is welded or otherwise fixedly attached through mounting plate 30 to the top surface of the main shaft 24, three inches forward of the rear edge of the main shaft 24. Shaft 32 is mounted perpendicular to the length of the main shaft 24. The pair of pillow blocks 38 and 39 and bellcrank 82 fit onto the right hand end of shaft 32 to pivotably secure bellcrank 82 about shaft 32.

A one inch wide by five inch long rod end mount extension bar 34 is welded to the left hand end of shaft 32 such that rod end mount extension bar 34 extends rearward and parallel to main shaft 24. A one inch square rod end mount 36 is welded perpendicularly to the rearward end of rod end mount extension bar 34, such that rod end mount 36 extends away from universal joint support tower 14 in line with the midpoint of the left hand side of universal joint support tower 14.

A linkage rod 106 is connected to rod end mount 36 though rod end 108. The upper end of linkage rod 106 is connected to rod end mount 102 through rod end 104. Rod end mount 102 is fixedly attached to the underside of seat mounting plate 92 at a point in line with, and five inches to the left of the midpoint of, universal joint 98.

A linkage rod 86 is connected to rod end 84. Rod end 84 is connected to rod end mount 83, which is welded to the upper quadrant of bellcrank 82. The upper end of linkage rod 86 is connected to rod end mount 90 through rod end 88. Rod end mount 90 is fixedly attached to the underside of seat mounting plate 92 at a point in line with, and five inches forward of the midpoint of, universal joint 98.

The uppermost winding of resistance inducing coil spring 110 is fastened to the underside of seat mounting plate 92 with bolt 114 through four inch square clamp plate 112. The midpoint of coil spring 110 is positioned six inches behind, and in line with, the midpoint of the universal joint 98. The lowermost winding of coil spring 110 is fastened to the upper surface of base frame 10 with bolt 118 through four inch square clamp plate 116. The midpoint of coil spring 110 is positioned six inches behind, and in line with, the midpoint of universal joint support tower 14.

Figure 5:
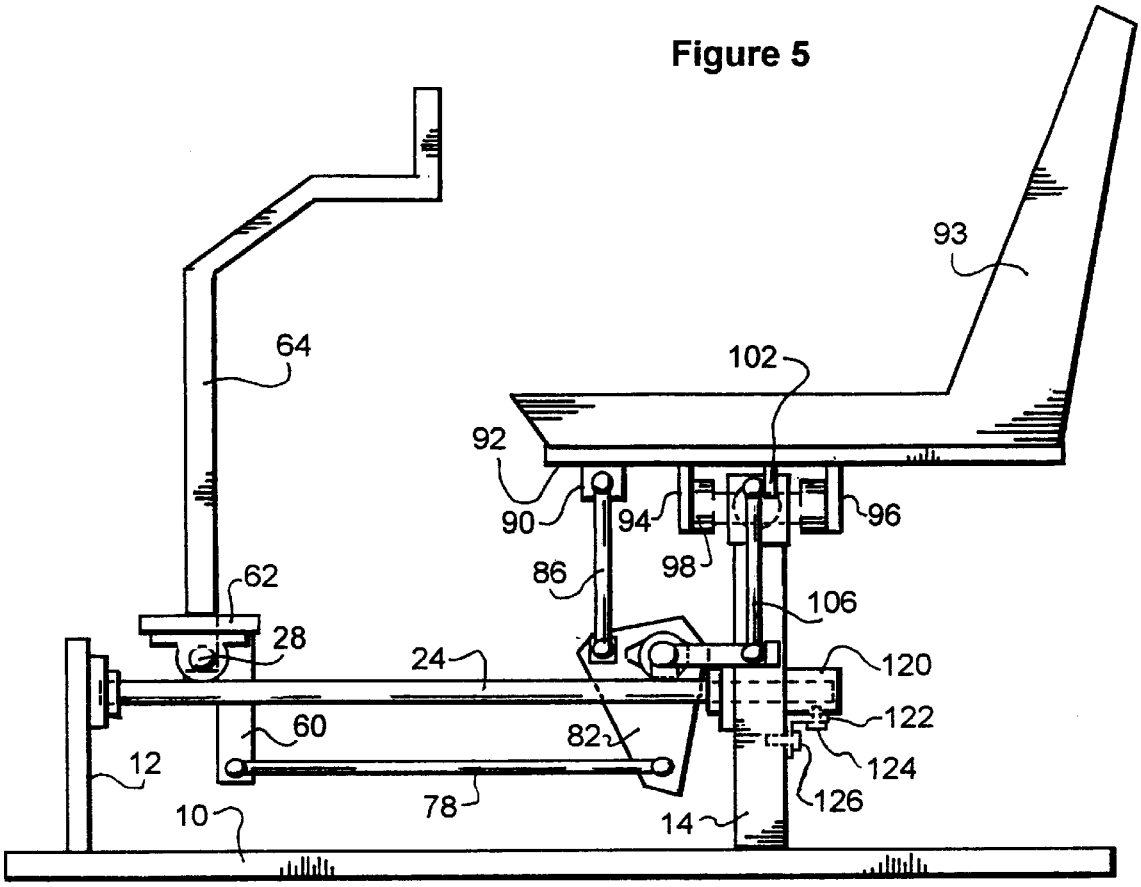
FIG. 5 is an additional embodiment of the invention where the coil spring is replaced with standard isolastic tensioners. This side elevation view details the placement of the roll axis tensioner just rearward of the universal joint support tower.
Figure 6:
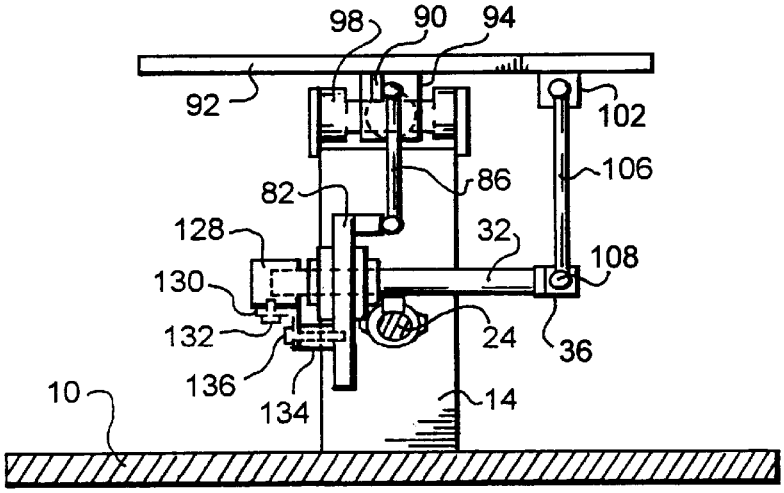
FIG. 6 is an additional embodiment of the invention where the coil spring is replaced with isolastic tensioners. This front-on view details the placement of the pitch axis tensioner as if the motion platform had been cut in halfjust forward of the bellcrank.

In the additional embodiment of the invention as presented in FIGS. 5 and 6, the coil spring 110 is replaced with two resistance inducing isolastic tensioners 120 and 124. Isolastic tensioners 120 and 124 are standard Rosta parts available through the Lovejoy bearing supply company. Isolastic tensioner 120 is fitted over the rearward end of main shaft 24 and secured at its outer surface to universal joint support tower 14 with clamp 122 and bolts 124 and 126. Isolastic tensioner 128 is located adjacent to bellcrank 82 and fitted to the end of shaft 32. Isolastic tensioner 128 is secured at its outer surface to clamp 130 with bolt 132. Clamp 130 is secured through standoff 134 to bellcrank 82 with bolt 136.

The design of the invention disclosed herein is such that a broad range of standard, readily available position sensing elements can be integrated into the mechanism. In the interest of clarity of the drawing figures, none of these sensors are shown. Additional elements which are not shown but can be readily adapted to the mechanism, include foot pedals, vibration or force inducing components, visual displays, audio transducers, and body panels.

OPERATION OF THE INVENTION

The preferred embodiment of the invention disclosed herein is intended to be used in conjunction with electronically integrated visual displays and sound presentation systems.

An operator sits in the provided seat 93 and, in response to cues presented by the accompanying media displays, applies manual pressure to joystick lever 64. The seat 93 is mounted to the operator support platform 92 through roller bearing universal joint 98, which is mounted on top of the universal joint support tower 14. The joystick lever 64 actuates the linkages 86 and 106 though bellcrank 82 and linkage 78. Because the user operates the joystick lever 64 at a distance of several feet from the lever pivot point, and the linkages are placed at a distance offset from the pivot points of universal joint 98, a large mechanical advantage is created. Moving the joystick lever 64 in any direction causes the operator support platform 92 to move in the same direction, accurately simulating the pitch and roll motion of an aircraft. As in a true aircraft, the user support plate 92—simulating the fuselage motion—responds a fraction of a second after the joystick lever 64 is pushed or pulled. Any incorporated position sensing elements which are actuated by the motion of joystick lever 64 will cause the electronically integrated visual display to move in perfect relative synchronization with the operator.

When the mechanism is in use, the coil spring 110 acts as a resistance inducing element which offsets the shifting weight of the operator. When the operator exits the mechanism, the coil spring 110, which is mounted between the operator support platform 92 and the base frame 10, urges the operator support platform 92 back to its neutral position. Because of the inherent load balancing capabilities of the invention disclosed herein, operators weighing from forty to four hundred pounds will experience virtually the same range of motion with the same amount of effort.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is limited only by the following claims.

What is claimed is:

1. A dual axis mechanically actuated motion platform comprising, in combination:

a base frame;

a seat mounting means secured to said base frame through a universal joint;

a lever arm pivotably secured to said base frame;

at least one linkage arranged to increase the mechanical advantage of any force applied to said lever arm, and to apply said force to position said seat mounting plate in concert with said lever arm;

and at least one resistance inducing means mounted so as to counteract any offset load borne by said seat mounting means.

2. A dual axis mechanically actuated motion platform according to claim 1 which translates a directional force applied to a moveable lever arm laterally displaced from a user support platform into movement of said user platform which follows the directional movement of said lever arm.

3. A dual axis mechanically actuated motion platform according to claim 1 which includes a resistance inducing means mounted to automatically center the operator support platform relative to said base frame.

* * * * *